US006240577B1

(12) United States Patent
Worthy

(10) Patent No.: US 6,240,577 B1
(45) Date of Patent: Jun. 5, 2001

(54) METHOD AND APPARATUS FOR A BATHTUB MOUNTABLE CHAIR

(76) Inventor: Ricky L. Worthy, 3342 O'Hara Dr. South, Macon, GA (US) 31206

( * ) Notice: Subject to any disclaimer, the term of this patent is extended or adjusted under 35 U.S.C. 154(b) by 0 days.

(21) Appl. No.: 09/420,219

(22) Filed: Oct. 18, 1999

(51) Int. Cl.[7] ..... A47K 3/022; A47K 3/12

(52) U.S. Cl. ..... 4/578.1; 4/573.1; 297/217.1

(58) Field of Search ..... 4/560.1, 561.1, 4/562.1, 571.1, 573.1, 578.1, 579, 604, 611; 297/112, 217.1

(56) References Cited

U.S. PATENT DOCUMENTS

| | | | | |
|---|---|---|---|---|
| 3,855,646 | | 12/1974 | Glickman . | |
| 4,168,549 | | 9/1979 | Davies . | |
| 4,391,006 | | 7/1983 | Smith . | |
| 4,475,256 | | 10/1984 | Hatala . | |
| 4,606,082 | * | 8/1986 | Kuhlman | 4/561.1 |
| 4,932,087 | | 6/1990 | Schmidt . | |
| 4,941,218 | | 7/1990 | McCartney . | |
| 4,975,991 | | 12/1990 | Peterson . | |
| 5,335,377 | | 8/1994 | Masyada . | |
| 5,373,591 | | 12/1994 | Myers . | |
| 5,475,880 | | 12/1995 | Guenther . | |
| 5,517,704 | | 5/1996 | Dagostino . | |
| 5,740,563 | * | 4/1998 | Gaddy | 4/579 |
| 5,822,809 | * | 10/1998 | Gallo | 4/578.1 |
| 5,903,935 | * | 5/1999 | Huelke | 4/560.1 |

* cited by examiner

*Primary Examiner*—Steven O. Douglas
*Assistant Examiner*—Kathleen J. Prunner
(74) *Attorney, Agent, or Firm*—Patent Focus, Inc.; Richard G. McComas

(57) ABSTRACT

A bathtub mountable chair seat for the transfer of a physically challenged bather from the exterior of a typical bathtub to the interior of the bathtub for bathing. The chair seat allows wheelchair accessibility in confined spaces and mechanical maneuverability in transferring the bather. The chair seat provides support for the legs or the any portion or member of the legs of the bather during transfer and/or while bathing. The chair seat has a back attached thereto suitable for supporting the bather in a sitting position. The chair seat has a leg extension housing mounted thereto in such a way as to allow selectable extension of a portion thereof that supports the bather's legs. The chair seat along with the leg extension housing is rotatably affixed to a rectangular member that is slidably insertable into a rack adapted to rest on the longitudinal edges of the bathtub. The chair seat has an arcuately shaped telescoping frame canopy mounted thereto to aid the bather in standing while bathing. The telescoping frame canopy has a telescoping extension member that may be protracted or retracted over the chair seat. The arcuately shaped telescoping frame canopy and the leg extension housing are fully rotatable.

14 Claims, 6 Drawing Sheets

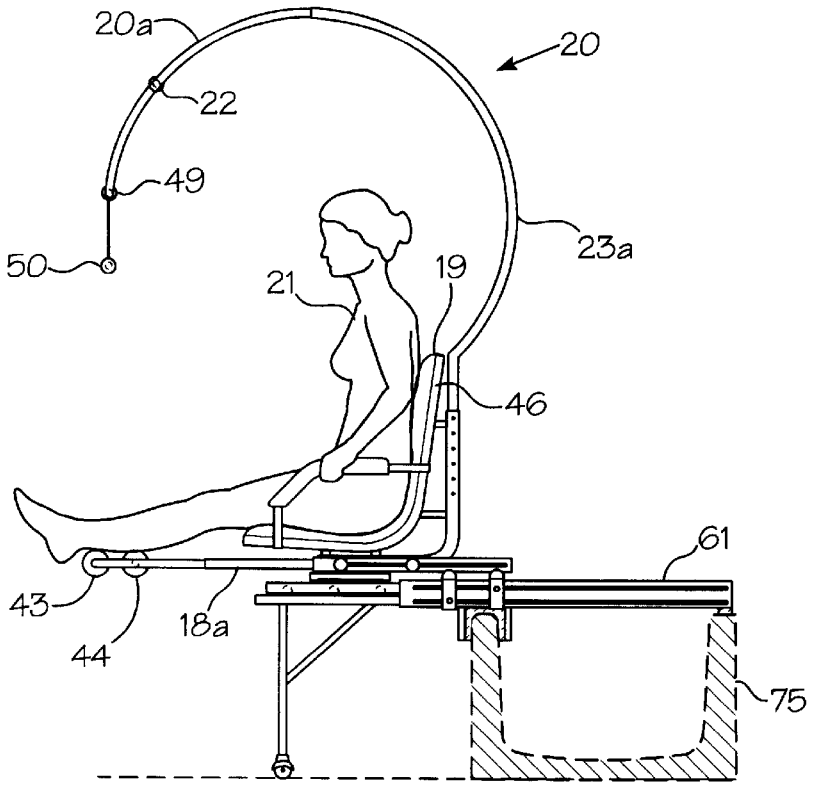
Fig. 2a
Fig. 2b
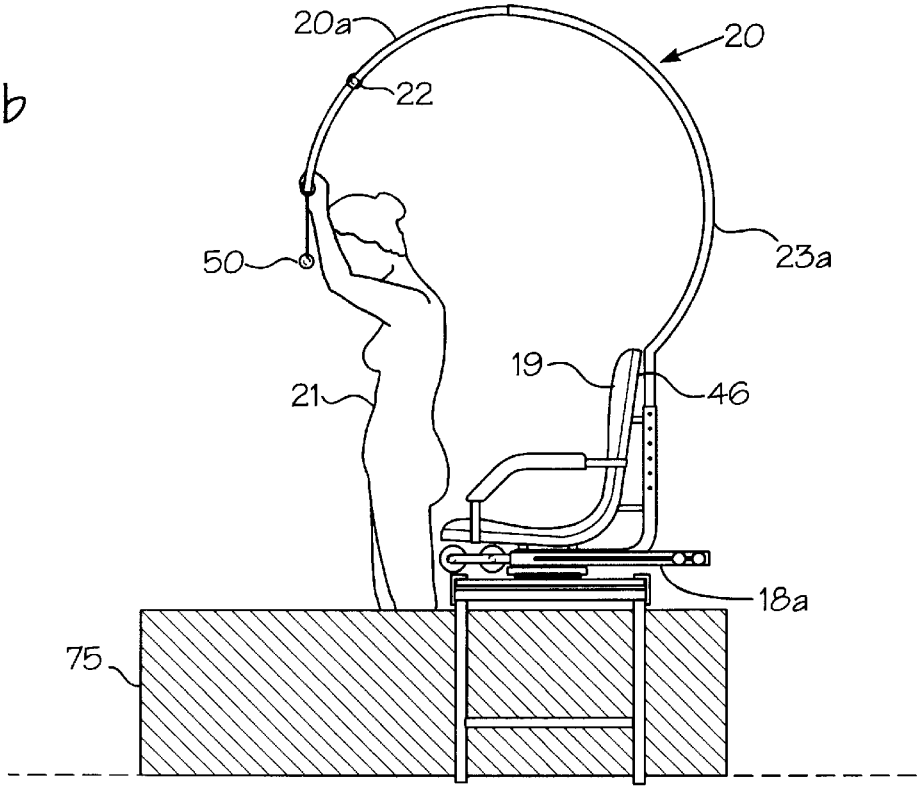

METHOD AND APPARATUS FOR A BATHTUB MOUNTABLE CHAIR

FIELD OF THE INVENTION

The invention relates, in general, to a method and apparatus for bathing. In particular, the invention relates to a method and apparatus for a bathtub mountable chair seat. More particularly the invention relates to a bathtub mountable chair seat with a frame canopy used to enable physically impaired individuals to stand or sit while bathing.

BACKGROUND OF THE INVENTION

The physically challenged generally require special fixtures to assist them in bathing. A typical bathtub or bathtub shower arrangement usually proves to be an insurmountable challenge to the physically impaired. The typical bathtub is of standard rectangular size and generally is confined to a small area of the bathroom. Generally, three sides of the bathtub abut adjoining walls and the third side provides the entrance and exit of the bather.

The bather must be transferred from the exterior of the bathtub to the interior of the bathtub to bathe. The transferring of the bather who is physically impaired requires the assistance of an attendant or family member to execute the transference. In many instances, the attendant must lift the bather from a wheelchair or support the entire weight of the bather to execute the transfer. This maneuver puts the bather at risk of injury or physical strain and subjects the attendant to unnecessary physical exertion and potential injury. If the bather desires to shower rather than sit and be bathed, external supports must be fashioned to the surrounding walls of the bathtub. These supports are generally permanent fixtures to the walls and cannot be easily removed.

Attempts were made prior to the present invention to remedy the transference of a physically challenged individual or bather from the exterior of a bathtub to the interior of the bathtub by constructing a bathtub mountable chair. The bathtub mountable chair, in one case, partially extends from the exterior of the bathtub to the interior of the bathtub. This remedy still requires the attendant to physically position the bather on the exterior portion of the chair and physically maneuver the bather to a position in the interior of the bathtub without mechanical assistance from the bathtub mountable chair.

Another attempt to remedy the transference of a physically challenged individual or bather is to construct a leg extension housing that mounts onto the longitudinal edges of the bathtub and a movable chair that slides along the leg extension housing. This attempt provides the attendant with a mechanical advantage in maneuvering the bather from the exterior of the bathtub to the interior of the bathtub by sliding the seated bather along the bathtub mounted leg extension housing. The bathtub mounted leg extension housing and chair still does not provide for accessible transference by the attendant from a wheelchair to the chair mounted onto the leg extension housing. The chair has a fixed position that is in line with the longitudinal edge of the bathtub. This position of the chair restricts the positioning of a wheelchair in transferring the bather from the wheelchair to the chair mounted onto the leg extension housing. In the close quarters of the typical bathroom, this may be impossible.

Another attempt to remedy the transference of a physically challenged individual or bather from the exterior of a bathtub to the interior of the bathtub is by constructing a bathtub mountable chair that swivels. The bathtub mountable chair, in this case, partially extends from the exterior of the bathtub to the interior of the bathtub. This particular chair does not provide support for the bather's lower leg or any portion or member during transference or bathing. The attendant still must lift the bather's legs over the edge of the bathtub while maneuvering the bather to a position within the interior of the bathtub. This multi-maneuver on the part of the attendant may injure the bather or attendant. An example of such an injury may be a bather with limited range of motion in the hips or legs that prevents any extended downward positioning of the legs.

It would be desirable to have a bathtub mounted chair that would allow wheelchair accessibility in confined spaces and mechanical maneuverability in transferring a bather from the exterior of a bathtub to the interior of the bathtub. The bathtub mountable chair would have provisions for supporting the legs or any portion or member of the legs of the bather during transfer and/or while bathing. The bathtub mountable chair would also have provisions for enabling a bather to stand while being supported by the chair thus allowing the bather to shower bathe.

SUMMARY OF THE INVENTION

The present invention provides a bathtub mounted chair that allows the physically challenged, the partially physically impaired, or the wheelchair bound individual accessibility to a bathtub, shower, or the combination of bathtub and shower facilities. The present invention facilitates maneuvering wheelchairs in confined spaces and provides mechanical advantage in transferring a bather from the exterior of a bathtub to the interior of the bathtub. The present invention provides a mechanism for supporting the legs or any portion or member of the legs of the bather during transfer and/or while bathing. The present invention also has provisions for enabling a bather to stand while being supported by the chair thus allowing the bather to shower bathe.

The present invention has a rack that may, if desired, be adapted to rest on the longitudinal edges of a bathtub. The rack has a substantially rectangular member that is slidably insertable into the interior of the rack. The rectangular member has a rotatable platform member mounted thereon. The rotatable platform member is mounted intermediate the rack and chair seat. The chair seat has a back attached thereto suitable for supporting the bather in a sitting position.

A leg extension housing is mounted to the chair seat. The leg extension housing has a telescoping leg extension portion or member that when extended engages the bather's legs, lower leg, or calf portion. If desired the telescoping leg member may be selectively positioned by moving the telescoping leg member from a fully protracted positioned relative to the chair seat to a fully retracted position under the front edge of the chair seat. If desired the telescoping leg extension member may be selectively positioned anywhere between the fully protracted and the fully retracted position relative to the chair seat. The selectability of the telescoping leg extension member in combination with the chair seat enables the bather to be unobstructively transferred via the slidably insertable rectangular member, from a position exterior to the bathtub to a position over the interior of the bathtub.

The present invention, may if desired, have a telescoping frame canopy connected to the leg extension housing and/or the chair back in such a way as to enable the bather to arcuately retract or protract a portion of the frame canopy. The frame canopy has first and second substantially C-shaped tube-like members that are spaced apart and have one respective end connected to the leg extension housing and/or chair back. The other end of the first and second C-shaped members have an elongated bar disposed therebetween. A portion of the first and second C-shaped members containing the bar is selectively and slidably insertable into the remaining portion of the frame canopy. The telescoping frame canopy's retractable portion or member may be selectively secured in any position between fully protracted and fully retracted. The telescoping frame canopy's retractable portion or member enables the bather to be seated in the chair or to be in a standing position while bathing.

BRIEF DESCRIPTION OF THE DRAWINGS

The invention is illustrated in the drawings in which like reference characters designate the same or similar parts throughout the figures of which:

FIG. 2*a* illustrates a side view diagram of the present invention mounted onto a bathtub, FIG. 2*b* illustrates a side view diagram of the present invention extending over the interior of the bathtub of FIG. 2*a*.

DESCRIPTION OF THE EMBODIMENTS OF THE PRESENT INVENTION

Figure 1A:
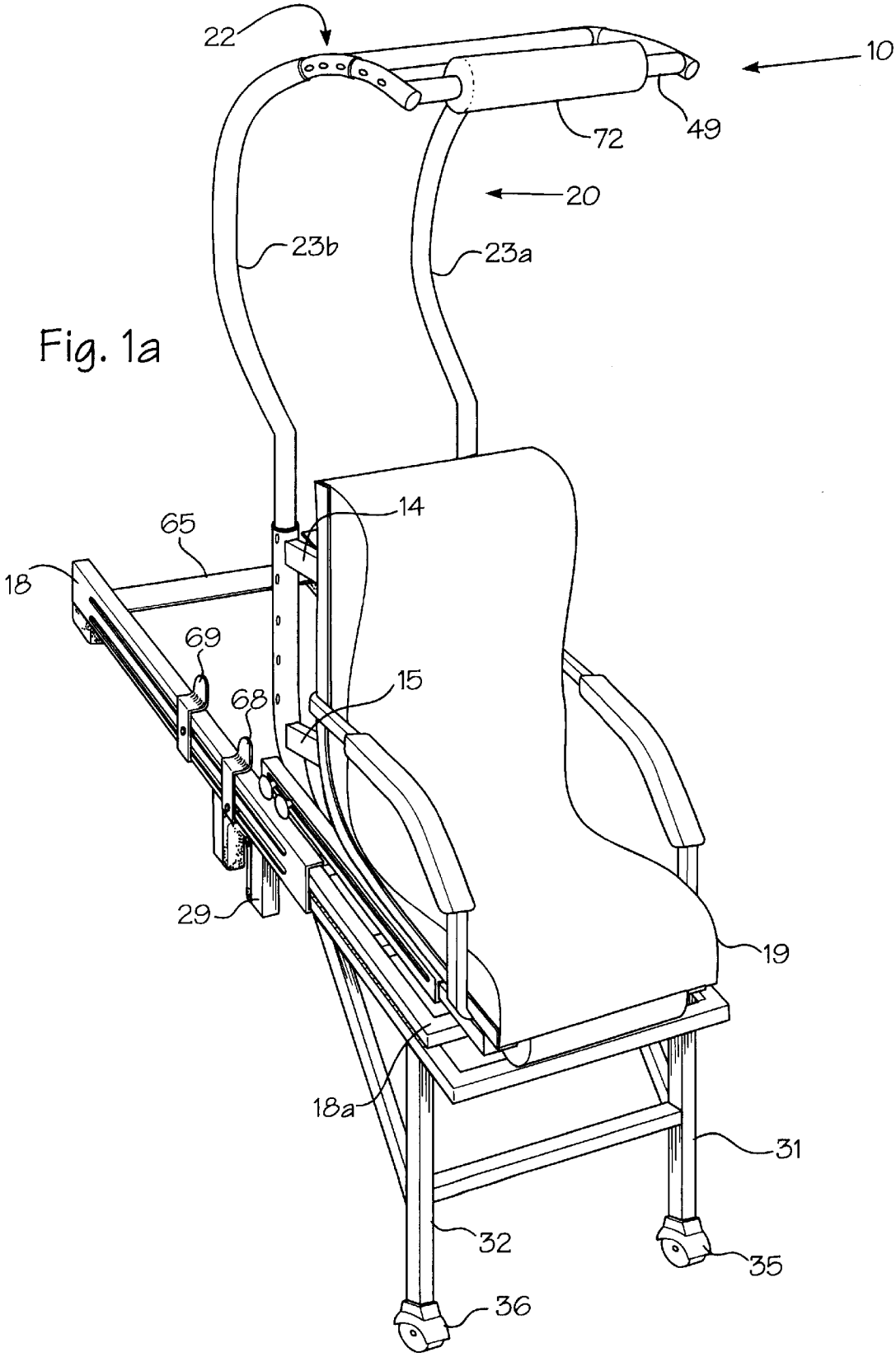
FIG. 1*a* illustrates a perspective view diagram of the preferred embodiment of the present invention.

Before describing in detail the particular improved bathtub mountable chair seat operation in accordance with the present invention, it should be observed that the invention resides primarily in a novel structural combination of conventional components, associated control of the aforementioned bathtub mountable chair seat, and not in the particular detailed configuration thereof. Accordingly, the structure, control, and arrangement of these conventional components have, for the most part, been illustrated in the drawings by readily understandable diagram representations and schematic diagrams. The drawings show only those specific details that are pertinent to the present invention in order not to obscure the disclosure with structural details which will be readily apparent to those skilled in the art having the benefit of the description herein. For example, locking mechanisms 12 and 13, FIGS. 1*b*, 1*c* and 1*d* are repeatedly used to secure numerous connections to the present invention 10. Various portions of the locking mechanisms 12 and 13 have been simplified in order to emphasize those portions that are most pertinent to the invention. Thus, the schematic diagram illustrations of the Figures do not necessarily represent the mechanical structural arrangement of the exemplary system, and are primarily intended to illustrate major hardware structural components of the system in a convenient functional grouping whereby the present invention may be more readily understood.

AN OVERVIEW OF THE PRESENT INVENTION

Figure 1B:
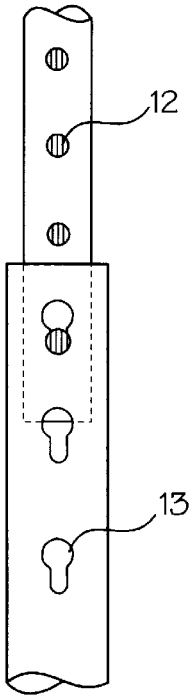
FIG. 1*b* illustrates a front view diagram of the telescoping frame canopy locking mechanism of FIG. 1*a*.
Figure 1C:
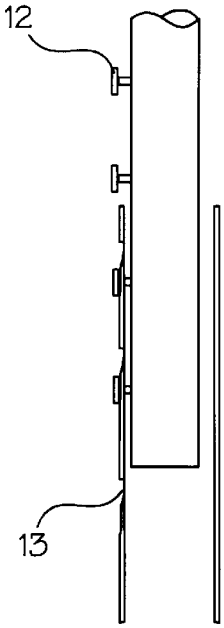
FIG. 1*c* illustrates a cutaway side view diagram of the telescoping frame canopy locking mechanism of FIG. 1*b* in a first operating position.
Figure 1D:
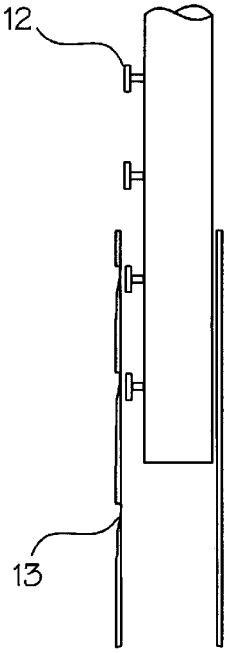
FIG. 1*d* illustrates a cutaway side view diagram of the telescoping frame canopy locking mechanism of FIG. 1*b* in a second operating position.

The preferred embodiment of the present invention 10, FIG. 1*a* is a bathtub mountable chair seat that converts an ordinary or standard bathtub into a shower/bath facility for the physically challenged. Any type bathtub of any size may be used in conjunction with the present invention 10. An example of a bathtub is manufactured by American Standard.

Figure 4A:
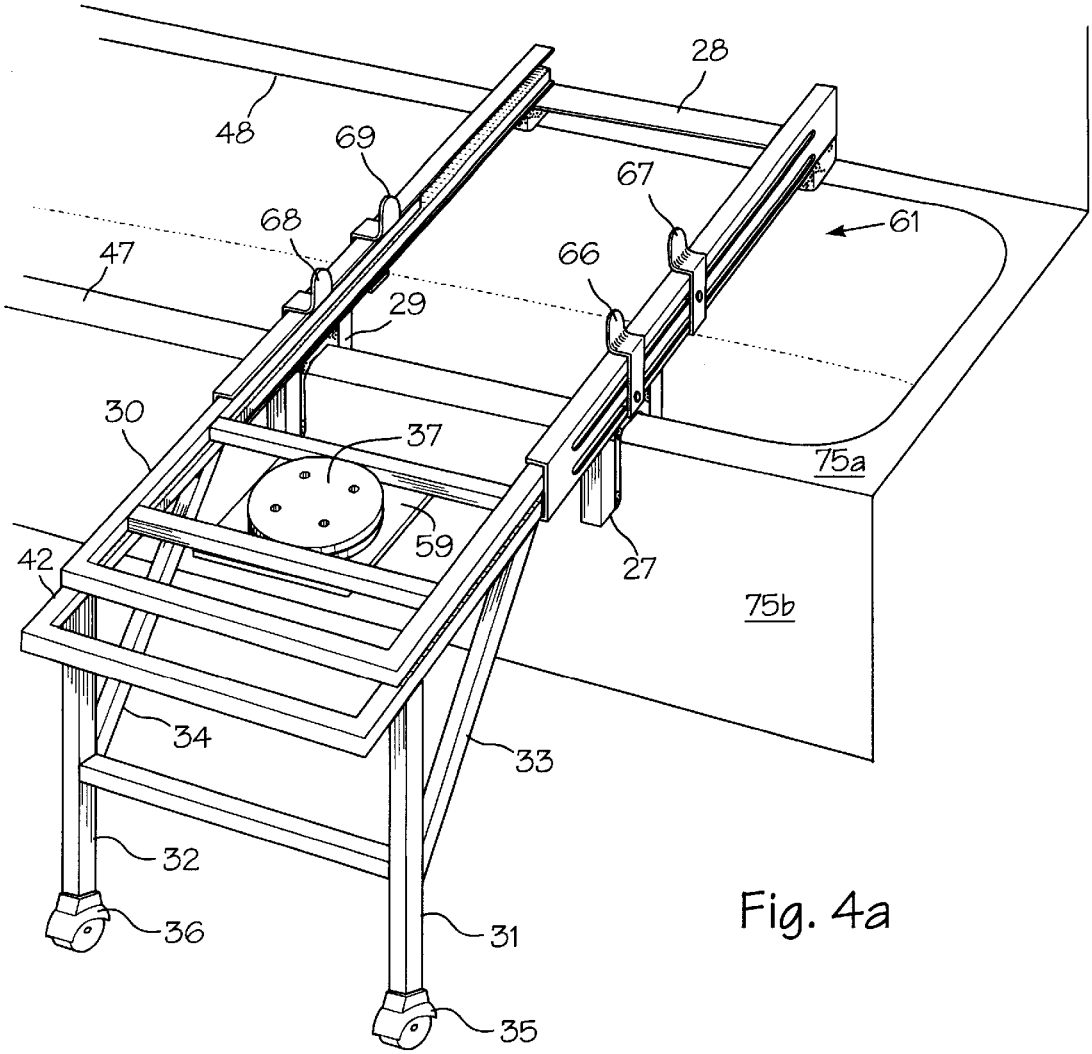
FIG. 4*a* illustrates a perspective view diagram of a rack adapted to rest on the longitudinal edges of the bathtub.

The present invention 10, FIG. 1*a* comprises, in part, a rack 61, FIG. 4*a* that has first and second slidably insertable rectangular members 30 and 42 respectively, a rotatable platform member 37 mounted to the first rectangular member 30, and a chair seat 19 mounted to the rotatable platform member 37. The chair seat 19 has a leg extension housing 18 and telescoping leg extension member 18*a* mounted thereto. If desired a telescoping frame canopy 20, FIG. 1*a* may be mounted to the chair seat 19 and/or the leg extension housing 18.

In general, a physically challenged person or user 21, FIG. 2*a* is positioned on the chair seat 19 with her legs positioned atop the telescoping leg extension 18*a*. The user 21, with legs extended, is moved to a position over the interior of the bathtub along rack 61. The chair seat 19 and the telescoping leg extension 18*a* are then rotated to any convenient position for bathing. If desired the chair seat 19 and the telescoping leg extension 18*a* may be rotated to a position aligned with the longitudinal length of the bathtub. The telescoping leg extension 18*a* may, if desired, be retracted into the interior of the leg extension housing 18. The user 21 may, if desired, grasp the telescoping frame canopy 20, FIG. 2*b* and lift herself to a standing position for bathing. If the user 21 is unable to lift herself to a standing position, she may require assistance to stand and use the telescoping frame canopy 20 for support while in the standing position. The telescoping frame canopy 20 has a top portion or member 22, FIG. 3*a* that is moveable. The moveable top portion or member 22 telescopes or slides into the tube-like portions 23*a* and 23*b* of the frame canopy 20. The user 21 or others may, if desired, retract or protract the top portion or member 20*a* to aid the user 21 in sitting or standing while bathing.

A MORE DETAILED DISCUSSION OF THE PRESENT INVENTION

The Bathtub Mountable Rack

The rack 61, FIG. 4*a* may, if desired, be adapted to rest on the longitudinal edges 47 and 48 of the bathtub 75. The rack 61 along with other structural components of the present invention 10 may be fabricated from any convenient or suitable material. Examples of materials may be steel, aluminum, sheet metal, plastic, or composite material, Any structural member of the leg extension housing 18 may, if desired, be hollow and/or coated with a moisture impervious substance to prevent or reduce the oxidation of any component of the present invention 10.

The rack 61, FIG. 4*a* compromises in part, a substantially U-shaped member 25 that has rails or tracks 26*a* and 26*b* (not shown) formed on the interior surface of the U-shaped member. The U-shaped member 25 has one end 28 that rests on one of the longitudinal edges of the bathtub 75. The opposite end or open end of the U-shaped member 25 rests on the other longitudinal edge of the bathtub 75. If desired a portion of the U-shaped member's 25 open end extends outwardly from the longitudinal edge of the bathtub 75 providing support for the rack 61. The U-shaped member's 25 open end is positionally held in place by a pair of adjustable U-shaped brackets 27 and 29 (not shown). The U-shaped brackets 27 and 29 may, if desired, be connected to the U-shaped member 25 by any convenient means. The U-shaped brackets 27 and 29 may, if desired, be adjusted in relation to the U-shaped member 25 to accommodate the varying widths of the bathtub's side portion or member 75*a*. The U-shaped brackets 27 and 29 may also be pressure fitted or clamped to the sidewalls 75*b* of the bathtub 75.

Figure 4B:
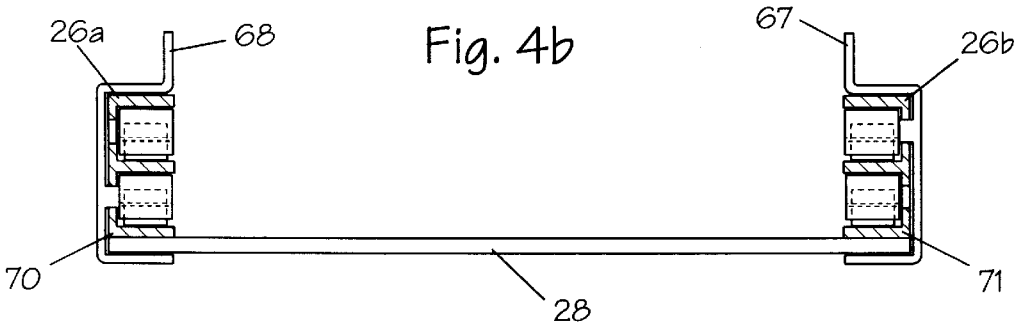
FIG. 4*b* illustrates an end view diagram of the rack of FIG. 4*a*.

A first substantially rectangular member 30 FIG. 4*b* is sized to be slidably insertable within the interior tracks 26*a* and 26*b* of the U-shaped member 25. The first rectangular member 30 may, if desired, be fabricated from the same or different materials as the leg extension housing 18. The first rectangular member 30 slides along the interior tracks 26*a* and 26*b* in relation to the U-shaped member 25. A second substantially rectangular member 42 is sized to be slidably insertable within the interior tracks 70 and 71, FIG. 4*b* of the U-shaped member 25. The second rectangular member 42 may, if desired, be fabricated from the same or different materials as the leg extension housing 18. The second rectangular member 42 has at least one depending leg 31 to support the weight of the member 42 once it is filly or partially extended from the U-shaped member 25. The leg 31 may, if desired, be positioned anywhere along the first rectangular member 42 that supports the weight of the first rectangular member 30. If desired a second depending leg 32 may be added to provide additional support for the second rectangular member 42. The pair of legs 31 and 32 may be spaced apart and supported by braces 33 and 34 respectively connected to the second rectangular member 42. The depending legs 31 and 32 may have casters or wheels 35 and 36 mounted thereon to aid in the first rectangular member 30 sliding into the U-shaped member 25. The first and second rectangular members 30 and 42 are independently slidably insertable into the interior of U-shaped member 25. The first rectangular member 30 glides atop the second rectangular member 42. If desired a plurality of rollers may be intermediately mounted between the first and second rectangular members 30 and 42 to aid in the sliding of one member over the other member.

Figure 3A:
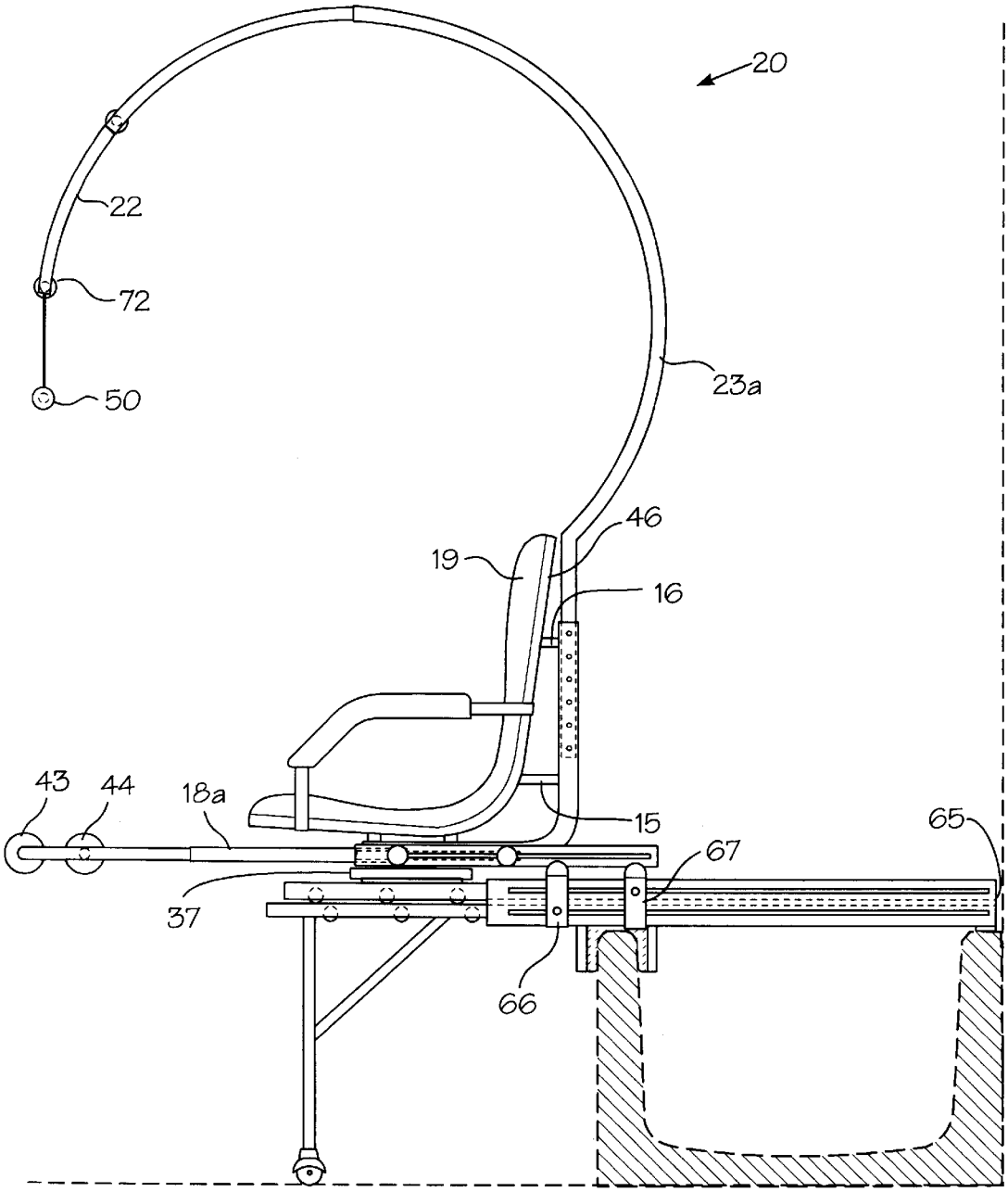
FIG. 3*a* illustrates a side view diagram of a protracted telescoping frame canopy and a protracted leg extension of FIG. 2*a*.
Figure 3B:
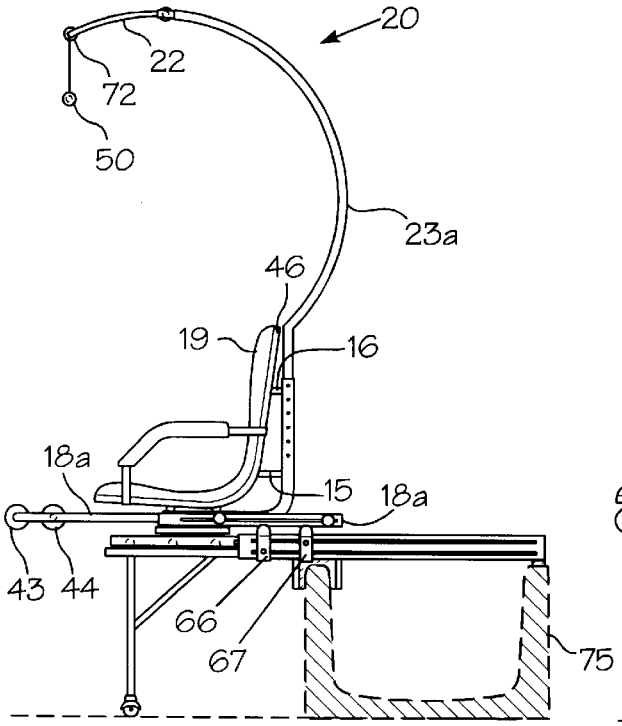
FIG. 3*b* illustrates a side view diagram of the partially retracted telescoping frame canopy and partially retracted leg extension of FIG. 2*a*.
Figure 3C:
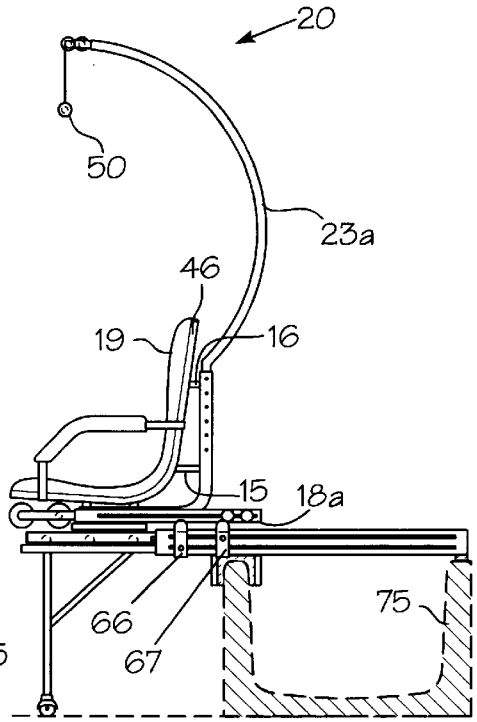
FIG. 3*c* illustrates a side view diagram of the fully retracted telescoping frame canopy and fully retracted leg extension of FIG. 2*a*.
Figure 3D:
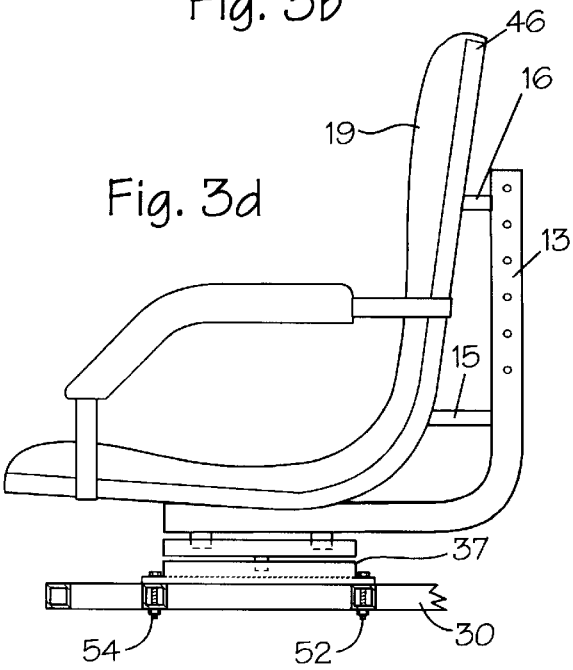
FIG. 3*d* illustrates a side view diagram of a rotatable platform attached to the chair seat, of FIG. 2*a*.
Figure 3E:
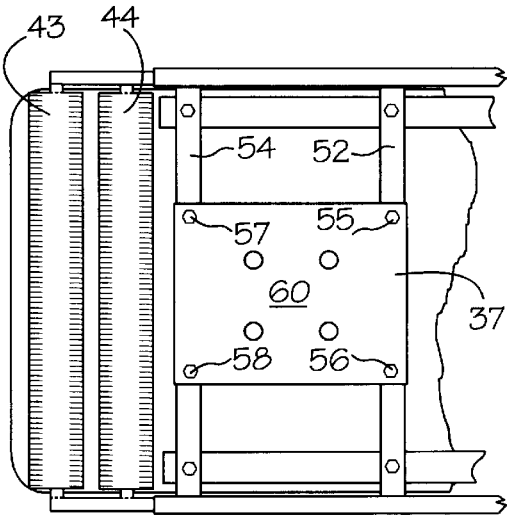
FIG. 3*e* illustrates a bottom view diagram of the rotatable platform attached to the chair seat, of FIG. 2*a*.

A substantially rectangular platform 37, FIG. 3*e* may, if desired, be fabricated from the same or different material as the leg extension housing 18. The platform 37 has a top surface 59, FIG. 4*a* and bottom surface 60, FIG. 3*c*. The top surface 59 is mounted to cross members 52 and 54. The cross members 52 and 54 are mounted to the first rectangular member 30 and the chair seat 19 by any convenient means. The bottom surface 60, FIG. 3*c* is mounted to first rectangular member 30 by at least one locking mechanism. If desired a plurality of nuts and bolts 55, 56, 57, and 58 may be used to secure the platform 37 to the first rectangular member 30. The platform 37 serves as a mounting vehicle for the chair seat 19, FIG. 1*a*. If desired the platform 37 may be mounted in such a way as to allow the platform 37 to freely rotate thereby allowing the chair seat 19 and leg extension housing 18 to freely rotate.

The Leg Extension Housing

Figure 1E:
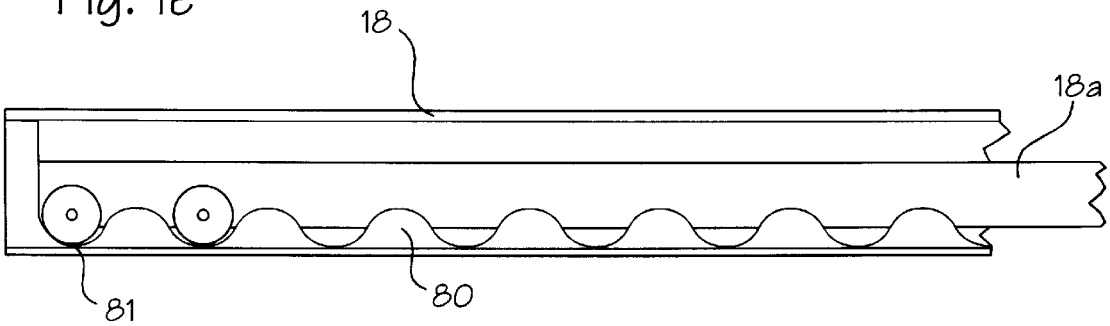
FIG. 1*e* illustrates a side view diagram of the locking mechanism of the leg extension housing.

The leg extension housing 18, FIG. 3*a* is fabricated from the same or different material as the rack 61. The leg extension housing 18 has at least one handle mounted thereto for facilitating the positioning of the chair seat 19. If desired a plurality of handles 66, 67, 68, and 69 may be securely mounted in any convenient location to facilitate the positioning of the chair seat 19 and the telescoping leg extension 18*a*. The leg extension 18 housing comprises, in part, a second U-shaped member 65. The second U-shaped member 65 may, if desired, be of tubular construction. The second U-shaped member 65 is securely mounted to the under carriage or bottom side portion or member of the chair seat 19. The hollow tubes allow for the insertion of leg extension portion or member 18*a*. The telescoping leg extension member 18*a* freely glides into the interior portion of the second U-shaped member 65. If desired a plurality of telescoping portions 18*b* may be added to the present invention 10 to facilitate the leg extension 18*a* being extended to any desired length. The telescoping leg extension 18*a* may be selectively extended, or retracted while positioned on the exterior or interior of the bathtub 75. If desired a plurality of rounded humps or protuberances 80, FIG. 1*e* disposed along the interior track of the leg extension housing 18 provide a lock-in-place mechanism. The protuberances 80 selectively retain the rollers 81 between adjacent protuberances thereby selectively locking in place the leg extension housing 18. The telescoping leg extension 18*a* member provides support for the user's 21 legs and/or calf portion when the user 21 is seated in the chair seat 19. The telescoping leg extension 18*a* may, if desired, have at least one roller 43 mounted thereto. The position of the roller 43 may be adjacent the distal end of the telescoping leg extension 18*a*. If desired a second roller 44 may be mounted in proximity to the first roller 43. The roller 43 and 44 may be padded and rotated in a forward or reverse direction. The rollers 43 and 44 provide support to the user's 21 legs and/or calf portion when the user 21 is positioned in the present invention 10. The full extension of the telescoping leg extension 18*a* in relation to second U-shaped member 65 is selectable thereby allowing the user 21 to select a position that is most comfortable or supportive to his/her legs. An example of the fully extended or protracted position is generally illustrated in FIG. 3*a*. An example of the intermediate extended position is generally illustrated in FIG. 3*b*. The fully retracted position is generally illustrated in FIG. 3*c*.

The Bathtub Mountable Chair Seat

The bathtub mountable chair seat 19, FIG. 3*a* is mounted onto platform 37. The frame canopy 20 is connected to the leg extension housing 18 and if desired to the chair seat 19 by braces or struts 14, 15, 16, and 17, FIG. 1*a*. These braces provide the support for the frame canopy 20. The placement of the braces may, if desired, be located anywhere on the leg extension housing 18 and chair seat 19 that allows adequate support for the present invention 10.

The chair seat 19, FIG. 3*a* has a back portion or member 46 attached thereto providing back support for the user 21 while in the seated position. The chair seat 19 is rotatably mounted to platform 37, FIG. 3*d* and may be in any position relative to the first rectangular member 30. The actual position of the chair seat 19 in relation to the first rectangular member 30 is a matter of convenience to the user 21. The user 21, when first seated has her legs fully extended. The user 21, after being positioned over the interior of the bathtub 75, may desire to selectively reposition the telescoping leg extension 18*a* thus allowing her lower leg portion to be extended downward toward the bottom surface of the bathtub 75.

The Telescoping Frame Canopy

The telescoping frame canopy 20, FIG. 1*a* comprises, in part, a first substantially C-shaped tube like member 23*a*. The C-shaped tube like member may, if desired, be fabricated from the same or different material as leg extension housing 18. The C-shaped tube-like member 23*a* has one end connected to the leg extension housing 18 and if desired is braced to the chair back 46 by braces 16 and 17. A second substantially C-shaped tube-like member 23*b* is oppositely spaced from the first C-shaped member 23*a*. The second C-shaped member 23*b* has one end connected to the leg extension housing 18 and if desired is braced to the chair back 46 by braces 14 and 15. The other ends of both C-shaped members 23*a* and 23*b*, have a bar 49 connected there-between. The bar 49 may, if desired, be padded 72 for the safety, comfort, and convenience of the user 21. A plurality of bars may, if desired, be connected between the end sections of the C-shaped members 23*a* and 23*b*. All of the bars 49 and other structural components may, if desired, be padded for the safety, comfort, and convenience of the user 21. The telescoping frame canopy 20 forms an arc over the chair back 46 and the chair seat 19. The arcuate shape of the telescoping frame canopy 20, FIG. 2*a* may, if desired, be of any convenient size that accommodates the user 21 and the standard bathtub 75.

The telescoping frame canopy 20, FIG. 3*a* has a moveable portion or member 22 comprising, in part, the end sections of the C-shaped members 23*a* and 23*b* suspended between bar 49. The moveable portion or member 22, when fully protracted forms the arcuate shape as illustrated in FIG. 3*a*. The moveable portion or member 22, when fully retracted forms the shape illustrated in FIG. 3*c*. The moveable portion or member 22 freely slides or is insertable into the interior of the tube like structure of the telescoping frame canopy 20. The moveable portion or member 22 may, if desired, be selectively positioned anywhere along the arcuate path as generally illustrated in FIG. 3*b* by a clamping mechanism (not shown). The moveable portion or member 22 when fully protracted locks in place thereby preventing the moveable portion or member 22 from being disengaged from the telescoping canopy C-shaped members 23*a* and 23*b*. If desired a pull rope 50 may be added to the moveable portion or member 22. The pull rope enables the user 21 to notify others or medical personnel in the case of an emergency.

The Operation of The Present Invention

In operation, the present invention 10 is suitably mounted onto the bathtub 75, FIG. 2*a*. The user 21 is seated on chair seat 19 and the user's back is supported by chair back 46. The first rectangular member 30, FIG. 4*a* is fully extended. The telescoping leg extension 18*a* is fully extended supporting the user's legs on padded rollers 42 and 44. The moveable portion or member 22 of the telescoping frame canopy 20 may, if desired, be in either the retracted position, FIG. 3*c*, or in the protracted position, FIG. 3*a* or 3*b* depending on the desire or needs of the user 21. The chair seat 19 along with the leg extension housing 18 is rotated on the moveable platform 37 to a position parallel to the longitudinal edge of the bathtub 75. The user 21 along with the present invention 10 slides or is moved to a position over the interior of the bathtub 75. If desired the user 21 or another attending person may retract the telescoping leg extension 18*a* if it is protracted thereby allowing the user's 21 lower leg portions to extend downward. If desired the user 21 or another attending person may protract the moveable portion or member 22 of the telescoping canopy 20 if the moveable portion or member 22 is retracted. The user 21 may, if desired, grasp the padded bar 49 and lift herself to a standing position. If desired, the user 21, may use the padded bar 49 as a stabilizing mechanism once she is lifted to a standing position.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

I claim:

1. A bathtub mountable chair seat, having a back attached thereto suitable for supporting a user in a sitting position, comprising:

a) a rack having an outwardly extending portion, said outwardly extending portion adapted to extend outwardly from at least one of the longitudinal edges of a bathtub;

b) a first substantially rectangular member slidably insertable into said rack's outwardly extending portion;

c) a platform member rotatably disposed intermediate the chair seat and said first rectangular member;

d) a leg extension housing being mountably disposed to the chair seat;

e) said leg extension housing having a telescoping leg extension member operationally disposed thereto;

f) a second substantially rectangular member slidably insertable into said rack's outwardly extending portion, said second rectangular member being mountably positioned below said first rectangular member;

g) at least one roller member mountably disposed to said telescoping leg extension member;

h) said telescoping leg extension member having a first operational position relative to the chair seat engaging the legs of the user seated in the chair seat;

i) said telescoping leg extension member having a second operational position relative to the chair seat, said second position selectively positioning the legs of the user relative to the chair seat;

thereby enabling the seated user to be transferred from said outwardly extending portion, with legs extended, along said telescoping leg extension member to a position over the interior of the bathtub via said rotatively mounted slidably insertable user leg extendable chair seat, the second rectangular member providing support to the first rectangular member when said first rectangular member is outwardly extended from said rack and said roller enabling the positioning of the user's leg to be adjusted as said telescoping leg extension member is selectively positioned.

2. A bathtub mountable chair seat as recited in claim 1 wherein said roller being positioned under the chair seat when said telescoping leg extension member is fully retracted.

3. A bathtub mountable chair seat as recited in claim 2 wherein said roller being mounted at one end of said telescoping leg extension member opposite the chair seat.

4. A bathtub mountable chair seat as recited in claim 3 wherein said roller having a padded surface.

5. A bathtub mountable chair seat as recited in claim 4 wherein said selective position is operationally locked in place.

6. A bathtub mountable chair seat as recited in claim 5 wherein said second rectangular member having at least one depending leg with at least one wheel mounted thereto.

7. A bathtub mountable chair seat as recited in claim 6 wherein said leg extension housing having at least one handle mountably disposed thereon for facilitating the movement of the telescoping leg extension member.

8. A bathtub mountable chair seat having a back attached thereto suitable for supporting a user in a sitting position, the chair seat being slidably insertable into a rack adapted to rest on the longitudinal edges of a bathtub, the rack having an outwardly extending portion suitable for facilitating the slidably insertable chair seat, comprising:

a) an arcuately shaped telescoping frame canopy connectively disposed to the chair seat;

b) said telescoping frame canopy having a telescoping extension member protracted over the chair seat;

c) said telescoping extension member being selectively retractable relative to the chair seat;

thereby allowing said telescoping extension member to be arcuately retracted or protracted unobstructively to the user.

9. A bathtub mountable chair seat as recited in claim 8 further comprising:

d) a telescoping leg extension housing connectively disposed to said chair seat;

e) a platform member rotatably disposed intermediate the chair seat and said telescoping leg extension housing;

f) said arcuately shaped telescoping frame canopy connectively disposed to said leg extension housing and the chair seat;

g) said leg extension housing having a leg extension member, said leg extension member having a first operational position engaging the legs of the user seated in the chair seat;

h) said leg extension member having a second operational position selectively positioning the legs of the user relative to the chair seat;

thereby enabling the seated user to be transferred from said outwardly extending portion with legs extended along said leg extension member to a position over the interior of the bathtub via said rotatively mounted slidably insertable user leg extendible chair seat.

10. A bathtub mountable chair seat as recited in claim 9 wherein said telescoping frame canopy is defined as:

a) a first substantially C-shaped tube-like member having one end connectively disposed to the chair seat;

b) a second substantially C-shaped tube-like member oppositely spaced from said first substantially C-shaped member, said second substantially C-shaped member having one end connectively disposed to the chair seat;

c) a pair of telescoping spaced apart extension members each having one respective end connectively disposed to opposing ends of at least one elongated bar-like member;

d) said pair of telescoping extension members' other respective ends being slidably insertable into said respective first and second C-shaped members other ends;

thereby said telescoping extension member enables the user to retract or protract said telescoping extension member thus enabling the user to be seated in the chair seat or to be in a standing position while bathing.

11. A bathtub mountable chair seat as recited in claim 10 wherein said telescoping frame canopy's telescoping extension members being selectively secured.

12. A bathtub mountable chair seat as recited in claim 11 wherein said bar-like member is padded.

13. A method for bathing a user in a bathtub mountable chair seat, the chair seat having a back attached thereto suitable for supporting the user in a sitting position, the chair seat being rotatably disposed to a substantially rectangular member that is slidably insertable into a rack adapted to rest on the longitudinal edges of the bathtub, the chair seat having a telescoping leg extension housing mounted thereto, the leg extension housing having a telescoping leg extension member slidably insertable thereto, the chair seat having mounted thereto a telescoping frame canopy, and the telescoping frame canopy having a telescoping extension member that unobstructively aids the user in bathing, comprising the steps of:

a) engaging the legs of the user with the telescoping leg extension member;

b) positioning the seated user with legs extended from a first position over the exterior of the bathtub to a second position over the interior of the bathtub;

c) rotating the chair seat to a suitable position for the seated user;

d) selecting a telescoping position of the leg extension member suitable to the seated user;

thereby enabling the seated user to be unobstructively transferred, via the rack mounted slidably insertable rectangular member, the rotatably disposed chair seat, and the telescoping leg extension member from an exterior position relative to the bathtub to a position over the interior of the bathtub for bathing.

14. A method for bathing as recited in claim 13 further comprising the steps of:

e) protracting the frame canopy in such a way as to position the frame canopy about the seated user when the seated user is in said first position;

f) retracting a portion of the frame canopy when the chair seat is in said second position;

thereby unobstructively enabling the user to bathe.

* * * * *